US012448711B2

(12) United States Patent
Imaizumi

(10) Patent No.: US 12,448,711 B2
(45) **Date of Patent: *Oct. 21, 2025**

(54) SEWING MACHINE

(71) Applicant: BROTHER KOGYO KABUSHIKI KAISHA, Nagoya (JP)

(72) Inventor: Kazutaka Imaizumi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/181,909

(22) Filed: Mar. 10, 2023

(65) Prior Publication Data

US 2023/0212803 A1 Jul. 6, 2023

Related U.S. Application Data

(63) Continuation of application No. 17/578,758, filed on Jan. 19, 2022, now Pat. No. 11,624,135, which is a (Continued)

(30) Foreign Application Priority Data

Dec. 15, 2017 (JP) ..... 2017-240577

(51) Int. Cl.
*D05B 35/12* (2006.01)
*D05B 79/00* (2006.01)

(52) U.S. Cl.
CPC ..... *D05B 35/12* (2013.01); *D05B 79/00* (2013.01)

(58) Field of Classification Search
CPC ..... D05B 19/12; D05B 35/12; D05B 79/00
See application file for complete search history.

(56) References Cited

U.S. PATENT DOCUMENTS 2,208,522 A 7/1940 Cullman
5,042,410 A 8/1991 Nakashima
(Continued)

FOREIGN PATENT DOCUMENTS

CN 104480646 A 4/2015
JP 2000-317187 A 11/2000
(Continued)

OTHER PUBLICATIONS

Feb. 5, 2019 International Search Report issued in International Patent Application No. PCT/JP2018/042441.
(Continued)

*Primary Examiner* — Nathan E Durham
(74) *Attorney, Agent, or Firm* — Oliff PLC

(57) ABSTRACT

A sewing machine includes a bed, a feed unit, a sewing unit, a projector, and a controller. The projector is configured to project a projection image to the bed. The controller is configured to, where the feed unit and the sewing unit do not perform sewing, execute a first control in which the controller causes the projector to project a first image to the bed, the first image including a first object and a second object, the first object indicating a planned sewing position, the second object indicating a reference position to position the workpiece. The controller is configured to, where the feed unit and the sewing unit perform sewing, execute a second control in which the controller causes the projector to project a second image to the bed, the second image including the first object and not including the second object.

7 Claims, 9 Drawing Sheets

Related U.S. Application Data continuation of application No. 16/898,295, filed on Jun. 10, 2020, now Pat. No. 11,248,324, which is a continuation of application No. PCT/JP2018/042441, filed on Nov. 16, 2018.

(56) References Cited

U.S. PATENT DOCUMENTS

| | | | | |
|---|---|---|---|---|
| 5,072,680 | A | 12/1991 | Nakashima | |
| 5,195,451 | A | 3/1993 | Nakashima | |
| 5,205,232 | A | 4/1993 | Sadeh et al. | |
| 8,700,200 | B2 | 4/2014 | Tokura | |
| 9,127,383 | B2 | 9/2015 | Yamanashi et al. | |
| 2007/0206371 | A1 | 9/2007 | Yamasaki | |
| 2009/0235855 | A1 | 9/2009 | Hamajima | |
| 2009/0301369 | A1 | 12/2009 | Kawaguchi et al. | |
| 2010/0242820 | A1 | 9/2010 | Fujihara et al. | |
| 2013/0139739 | A1 | 6/2013 | Naka et al. | |
| 2014/0000498 | A1* | 1/2014 | Yamanashi | D05B 19/12 112/102.5 |
| 2014/0090587 | A1 | 4/2014 | Ichiyanagi et al. | |
| 2014/0116309 | A1 | 5/2014 | Maki | |
| 2014/0182499 | A1 | 7/2014 | Matsushima | |
| 2015/0259841 | A1* | 9/2015 | Ihira | D05B 81/00 112/102.5 |
| 2018/0057985 | A1 | 3/2018 | Imaizumi | |

FOREIGN PATENT DOCUMENTS

| | | | |
|---|---|---|---|
| JP | 2007-229344 | A | 9/2007 |
| JP | 2009-000272 | A | 1/2009 |
| JP | 2009-207734 | A | 9/2009 |
| JP | 2009-225899 | A | 10/2009 |
| JP | 2009-291416 | A | 12/2009 |
| JP | 2013-116260 | A | 6/2013 |
| JP | 2014-068802 | A | 4/2014 |
| JP | 2014-087506 | A | 5/2014 |
| WO | 2017/056677 | A1 | 4/2017 |

OTHER PUBLICATIONS

Nov. 2, 2022 Notice of Allowance issued in U.S. Appl. No. 17/578,765.

* cited by examiner

SEWING MACHINE

CROSS-REFERENCE TO RELATED APPLICATION

This is a continuation application of U.S. patent application Ser. No. 17/578,758 filed on Jan. 19, 2022, which is a continuation application of U.S. patent application Ser. No. 16/898,295 filed on Jun. 10, 2020, which is a continuation application of International Application No. PCT/JP2018/042441 filed on Nov. 16, 2018 which claims priority from Japanese Patent Application No. 2017-240577 filed on Dec. 15, 2017. The entire contents of the earlier applications are incorporated herein by reference.

TECHNICAL FIELD

Aspects of the disclosure relate to a sewing machine.

BACKGROUND

A known sewing machine is capable of projecting a mark indicating a reference position to position a workpiece to be sewn. In the sewing machine, a marking light emits light to project a mark to a table as a reference position of a cloth placed on the table. After sewing, the marking light is turned off.

SUMMARY

During sewing, however, the marking light of the sewing machine remains on and may obstruct viewing.

Aspects of the disclosure provide a sewing machine having workpiece positioning efficiency and sewing efficiency.

According to one or more aspects of the disclosure, a sewing machine includes a bed, a feed unit, a sewing unit, a projector, and a controller. The feed unit includes a feed dog and is configured to allow the feed dog to feed a workpiece placed on the bed in a feed direction. The sewing unit includes a needle bar and a needle attached to the needle bar. The sewing unit is configured to move the needle up and down to form stitches on the workpiece fed by the feed unit. The projector is configured to project a projection image to the bed. The controller is configured to control the feed unit, the sewing unit, and the projector. The controller is configured to, where the feed unit and the sewing unit do not perform sewing, execute a first control in which the controller causes the projector to project a first image to the bed, the first image including a first object and a second object, the first object indicating a planned sewing position, the second object indicating a reference position to position the workpiece. The controller is configured to, where the feed unit and the sewing unit perform sewing, execute a second control in which the controller causes the projector to project a second image to the bed, the second image including the first object and not including the second object.

The sewing machine changes objects included in an image to be projected, depending on whether sewing is performed. During a non-sewing period, the sewing machine projects the first image including the first object that indicates a planned sewing position and the second object that indicates a reference position to position the workpiece, and thus improves the efficiency of positioning the workpiece as compared to a sewing machine that projects an image including one object. The sewing machine improves the sewing efficiency by reducing the number of objects included in the second image to be projected during sewing, as compared to a case where the number of objects included in an image to be projected is unchanged between during sewing and during a non-sewing period. The sewing machine thus improves the efficiency of positioning the workpiece without loss of the efficiency of sewing the workpiece.

DETAILED DESCRIPTION

A sewing machine 1 according to first to fourth embodiments is described with reference to the accompanying drawings. The drawings for reference are intended for use in describing technical features supported by the disclosure, and structures of a sewing machine described with the drawings are not limited thereto, but are merely an example.

Figure 1:
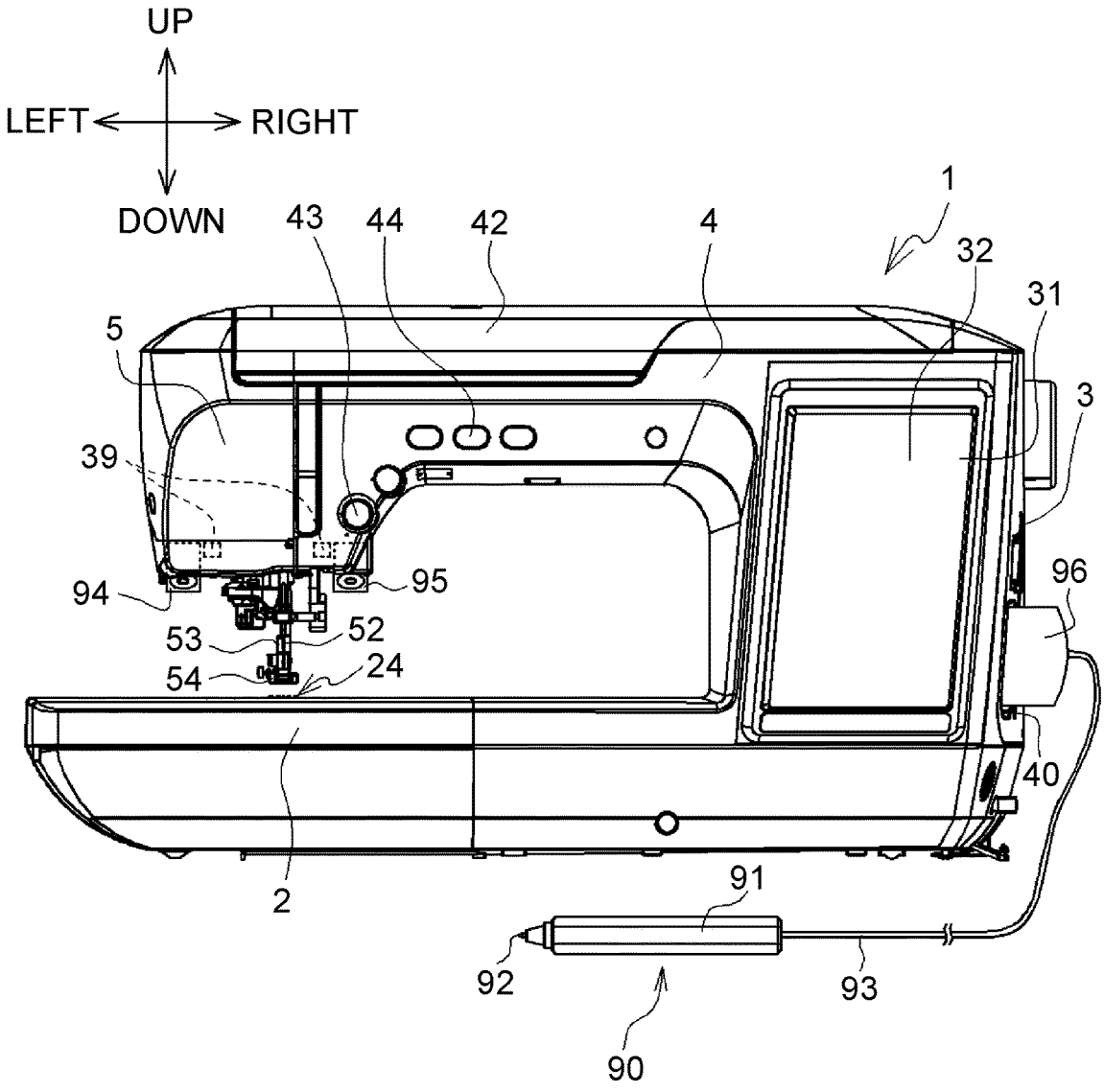
FIG. 1 is a perspective view of a sewing machine according to aspects of the disclosure.
Figure 2:
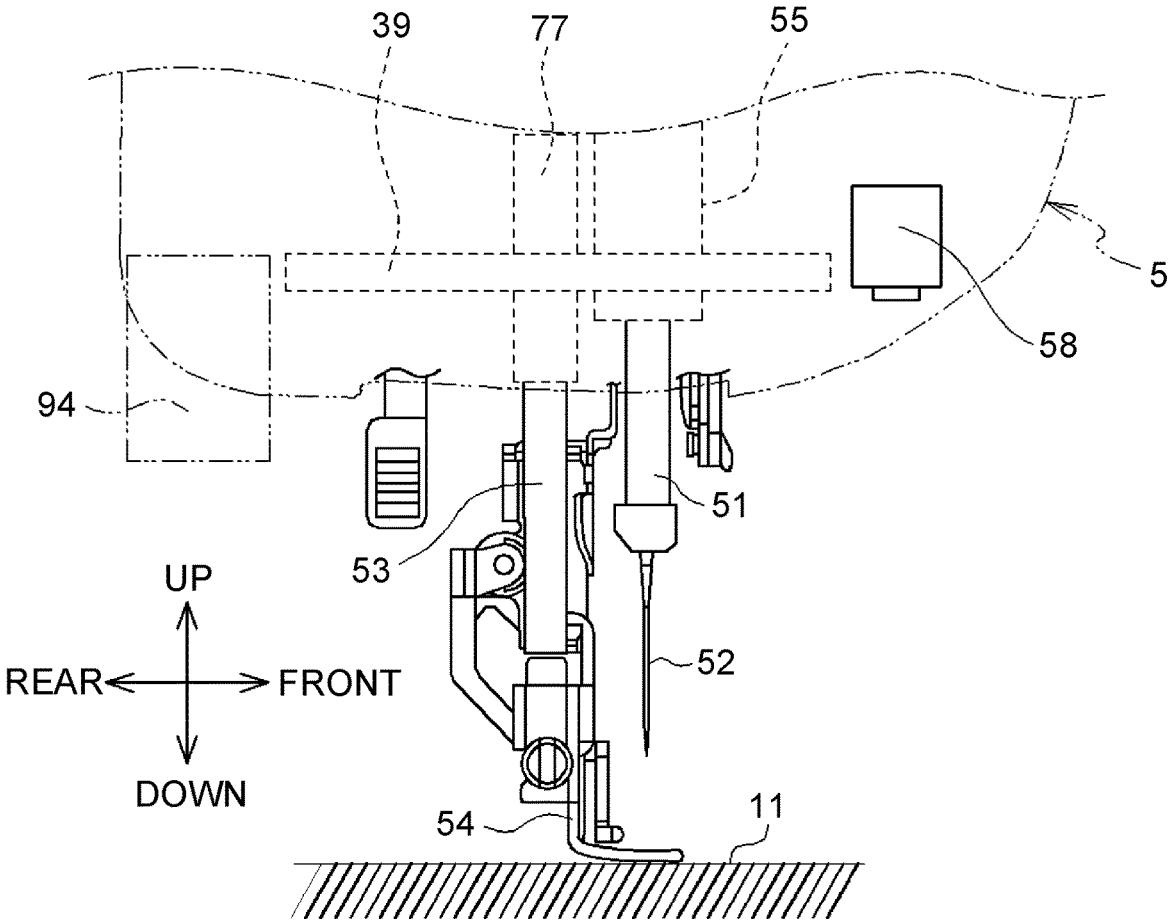
FIG. 2 is a left side view of the sewing machine with a presser bar at a first position.
Figure 3:
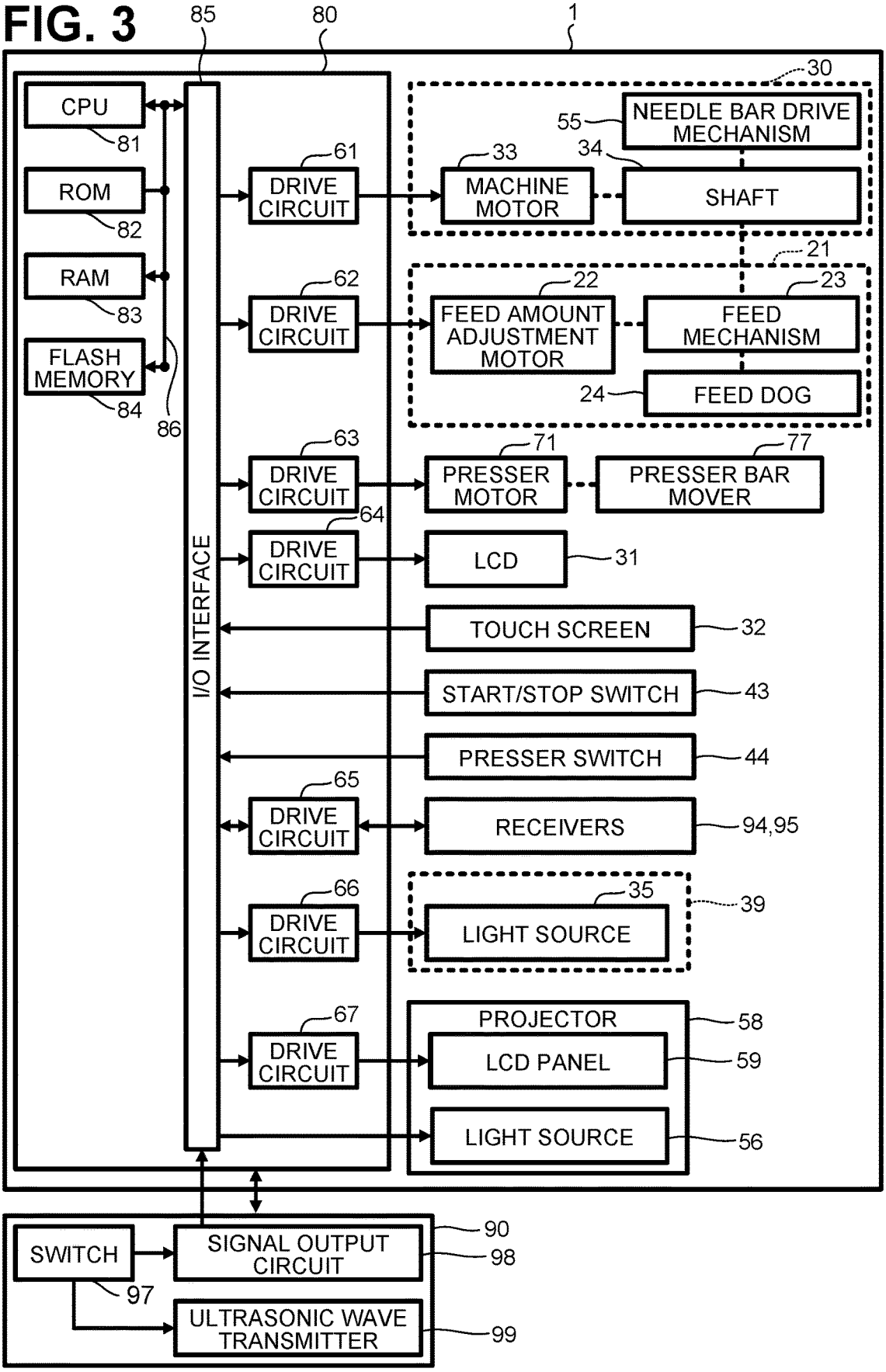
FIG. 3 is block diagram illustrating an electrical configuration of the sewing machine.

Referring to FIGS. 1 to 3, a configuration of the sewing machine 1 common to the first to fourth embodiments is described. In the following description, directional terminology, such as "up/upper," "down/lower," "front," "rear," "left," and "right," as labeled in the drawings, may be used. In the page of FIG. 1, an upper side, a lower side, a left side, and a right side respectively correspond to an upper side, a lower side, a left side, and a right side of the sewing machine 1. A surface of the sewing machine 1 with a liquid crystal display (hereinafter referred to as LCD) 31, which will be described later, corresponds to its front surface. A longitudinal direction of a bed 2 and a horizontal arm 4 corresponds to a left-right direction of the sewing machine 1. A side of the sewing machine 1 on which an upright arm 3 is located is the right side of the sewing machine 1. A direction in which the upright arm 3 is elongated is an up-down direction of the sewing machine 1.

As illustrated in FIG. 1, the sewing machine 1 includes the bed 2, the upright arm 3, and the horizontal arm 4. The bed 2 is a base of the sewing machine 1 and extends in the left-right direction. The upright arm 3 extends upward from a right end of the bed 2. The horizontal arm 4 extends to the left from an upper portion of the upright arm 3. A left end of the horizontal arm 4 includes a head 5.

As illustrated in FIG. 2, the bed 2 includes a needle plate 11 at an upper surface thereof. The needle plate 11 is disposed below a needle bar 51 of the head 5. The needle plate 11 has a needle hole (not illustrated) into which a needle 52 is inserted. In sewing, up-down movement of the needle bar 51 allows a tip of the needle 52 attached to a lower end of the needle bar 51 to enter the needle hole. A workpiece C (FIG. 5) is to be placed on upper surfaces of the bed 2 and the needle plate 11. The workpiece C is a piece of fabric to be sewn, for example. A position where the tip of the needle 52 pierces the workpiece C with the up-down movement of the needle bar 51 is referred to as a needle drop position. The sewing machine 1 includes, in the bed 2, a lower shaft, a feed unit 21 (FIG. 3), and a shuttle mechanism. The lower shaft is driven to rotate in synchronization with rotation of a shaft 34 (FIG. 3), which will be described later. The feed unit 21 includes a feed-amount adjustment motor 22 (FIG. 3). The feed-amount adjustment motor 22 is a pulse motor configured to adjust a feed amount and direction of when the feed unit 21 feeds the workpiece C. The feed unit 21 includes a feed dog 24 and is configured to allow the feed dog 24 to feed the workpiece C placed on the bed 2. For plain straight stitching, a feed direction corresponds to a rear direction, an upstream side in the feed direction corresponds to a front side, and a downstream side corresponds to a rear side. The shuttle mechanism is of a known type that is driven by the rotation of the lower shaft. The shuttle mechanism cooperates with the needle 52 attached to the lower end of the needle bar 51 to form stitches on the workpiece C.

The upright arm 3 includes a controller 80 (FIG. 3) and a machine motor 33 (FIG. 3) of the sewing machine 1. The machine motor 33 drives the shaft 34 disposed in the horizontal arm 4 to rotate. The shaft 34 is connected to the lower shaft via a timing belt (not illustrated). The LCD 31 and a touchscreen 32 are disposed at a front surface of the upright arm 3. The LCD 31 is configured to display an image including various items, such as commands, illustration, settings, and messages. The touchscreen 32 is disposed on a front surface of the LCD 31 to detect a position thereof to be approached, touched, or pressed. The touchscreen 32 is configured to accept an input of an operation using a finger or a special stylus. The sewing machine 1 includes a CPU 81 (FIG. 3) configured to, based on the position detected by the touchscreen 32, recognize an item selected on the image. Hereinafter, an operation on the touchscreen 32 by a user is referred to as a touchscreen operation. A user is allowed to select any item, with a touchscreen operation, such as a desired pattern to be sewn and a command to be executed.

A connector 40 is disposed at a right surface of the upright arm 3. The connector 40 connects to an ultrasonic pen 90 detachably. The ultrasonic pen 90 includes a connector 96, a cable 93, a pen body 91, and a pen tip 92. As illustrated in FIG. 3, the ultrasonic pen 90 further includes a switch 97, a signal output circuit 98, and an ultrasonic wave transmitter 99. The connector 96 is connected to the connector 40. The cable 93 connects the pen body 91 and the connector 96. The sewing machine 1 supplies power, via the connector 40, the connector 96, and the cable 93, to the ultrasonic pen 90, and receives an electrical signal outputted from the ultrasonic pen 90. The pen body 91 is tubular and stores the switch 97, the signal output circuit 98, and the ultrasonic wave transmitter 99. The switch 97 is turned on or off according to the position of the pen tip 92 relative to the pen body 91. The switch 97 switches the output state of the signal output circuit 98 and the ultrasonic wave transmitter 99. When the pen tip 92 is retracted in the pen body 91 and thus the switch 97 is turned on, the signal output circuit 98 outputs an electrical signal to the sewing machine 1 via the cable 93 and the ultrasonic wave transmitter 99 produces ultrasound.

An openable cover 42 is disposed at an upper portion of the horizontal arm 4. Although not shown, spools of upper thread are stored below the cover 42. In sewing, the upper thread of a spool is supplied through parts provided at the head 5 to the needle 52 attached to the needle bar 51. The horizontal arm 4 stores the shaft 34 extending in the left-right direction. The shaft 34 is driven to rotate by a machine motor 33 (FIG. 3). Switches including a start/stop switch 43 and a presser switch 44 are disposed on a lower left portion of a front surface of the horizontal arm 4. The start/stop switch 43 is used to input an instruction to start or stop sewing. The presser switch 44 is used to input an instruction to raise or lower the presser bar 53.

As illustrated in FIGS. 1-3, the sewing machine 1 includes, in the head 5, a needle bar 51, a presser bar 53, a needle bar drive mechanism 55, a presser bar mover 77, a pair of left and right lights 39, and a projector 58. The needle 52 is removably attached to a lower end of the needle bar 51. The presser foot 54 is removably attached to a lower end of the needle bar 53. The needle bar drive mechanism 55 is configured to drive the needle bar 51 in the up-down direction by the rotation of the shaft 34. The presser bar mover 77 is driven by a presser motor 71 and configured to move the presser bar 53 between a first position (FIG. 2) in proximity to the bed 2 and a second position spaced upward from the bed 2 further than the first position. The sewing unit 30 includes the needle bar 51, and is configured to move the needle 52 attached to the needle bar 51 up and down for forming stitches on a workpiece C being fed by the feed unit 21. The lights 39 each have a light source 35 to emit light to the bed 2 in a known manner, which is disclosed in, for example, Japanese Laid-Open Patent Publication No. 2009-225899. The light source 35 may be a white LED to illuminate a spot below the needle bar 51 (that is, a needle drop position PN in FIGS. 5A-5C) and its surroundings. The lights 39 extend in the front-rear direction. Each of the lights 39 is disposed at a corresponding one of left and right sides of the needle bar 51. Hereinafter, the lights 39 may be collectively referred to as a lighting unit 39.

The projector 58 is configured to project an image in a specified projection area RP (FIGS. 5A-5C) on the bed 2 (a workpiece C). The projector 58 includes a cylindrical casing, a liquid crystal panel (LCP) 59 (FIG. 3), a light source 56 (FIG. 3), and an image forming lens (not illustrated), which are disposed in the casing. The casing of the projector 58 is fixed to a machine casing in the head 5. The light source 56 is a LED. The LCP 59 is configured to modulate light from the light source 56 and form image beams for a projection image to be projected based on image data representing the projection image. The image forming lens uses the image beams formed by the LCP 59 to form an image in the projection area RP on the bed 2. The projection area RP is a rectangle elongated in the left-right direction and includes a needle drop position PN and an area upstream from the needle drop position PN in the feed direction. The needle drop position PN is located in a rear right portion of the projection area RP. As the projector 58 projects a projection image, from diagonally above, toward the workpiece C on the bed 2, the projection image undergoes image distortion correction. The flash memory 84 stores the size of the projection area RP of the projector 58 (e.g., a number of dots on the long and short sides of a rectangular area).

The head 5 includes, in its lower rear portion, receivers 94, 95 spaced apart from each other in the left-right direction. The receivers 94, 95 are configured to receive (or detect) ultrasound. The receivers 94, 95 are identical in structure. In the sewing machine 1, the receivers 94, 95 detect or receive ultrasound generated from the ultrasonic pen 90.

Referring to FIG. 3, an electrical configuration of the sewing machine 1 is described. The sewing machine 1 includes a controller 80. The controller 80 includes the CPU 81, a ROM 82, a RAM 83, the flash memory 84, an input/output ("I/O") interface 85, and drive circuits 61-67. The CPU 81 is connected to the ROM 82, the RAM 83, the flash memory 84, and the I/O interface 85, via a bus 86. The I/O interface 85 is electrically connected to the drive circuits 61-67.

The CPU 81 performs overall control of the sewing machine 1. The CPU 81 performs various calculations and processing relating to sewing and image projection, in accordance with programs stored in the ROM 82. The ROM 82 includes a plurality of storage areas (not illustrated), including a program storage area. The program storage area stores therein various programs for operating the sewing machine 1. For example, the program storage area stores programs for executing a main process, which will be described later. The RAM 83 can store information such as results of calculations performed by the CPU 81. The flash memory 84 stores various parameters required for the sewing machine 1 to execute processing. Examples of the parameters include variables each associating the coordinates in the world coordinate system with the coordinates in a coordinate system for a projection image of the projector 58. The world coordinate system indicates the coordinates in space and is unaffected by the center of gravity and other factors.

The drive circuit 61 is connected to the machine motor 33 to drive the motor 33 based on a control signal from the CPU 81. The drive circuit 62 is connected to the feed-amount adjustment motor 22 to drive the motor 22 based on a control signal from the CPU 81. The drive circuit 63 is connected to the presser motor 71 to drive the motor 71 based on a control signal from the CPU 81. The drive circuit 64 drives the LCD 31 to display an image or an operation screen on the LCD 31 based on a control signal from the CPU 81. The drive circuit 65 includes an amplifier that increases the power of a signal of ultrasound detected by the receivers 94, 95 and transmits the signal to the CPU 81. The drive circuit 66 allows the light source 35 to emit light based on a control signal from the CPU 81. The drive circuit 67 drives the LCP 59 of the projector 58 to display a projection image on the LCP 59 based on a control signal from the CPU 81.

The I/O interface 85 is further connected to the light source 56 of the projector 58, the touchscreen 32, the start/stop switch 43, the presser switch 44, and the ultrasonic pen 90. The light source 56 is turned on based on a control signal from the CPU 81 to project a projection image displayed on the LCP 59 onto the workpiece C, which is to be fed on the bed 2. The touchscreen 32 is configured to output, to the CPU 81, coordinate data indicating an input position of an operation using a finger or a special stylus. The CPU 81 is configured to, based on the coordinate data received from the touchscreen 32, recognize an item selected on the operation screen displayed on the LCD 31 and execute a corresponding process. The start/stop switch 43 and the presser switch 44 are each configured to receive and output, to the CPU 81, an input of an operation of the sewing machine 1, independently of the touchscreen 32. The CPU 81 is configured to, when receiving an input of an operation on the start/stop switch 43, output a control signal to start or stop sewing. The CPU 81 is configured to, when receiving an input of an operation on the presser switch 44, output a control signal to move the presser bar 53 to the first or second position. This enables the CPU 81 to determine whether the presser bar 53 is located at the first or second position. The signal output circuit 98 of the ultrasonic pen 90 is capable of outputting an electrical signal to the CPU 81 via the I/O interface 85.

Figure 4:
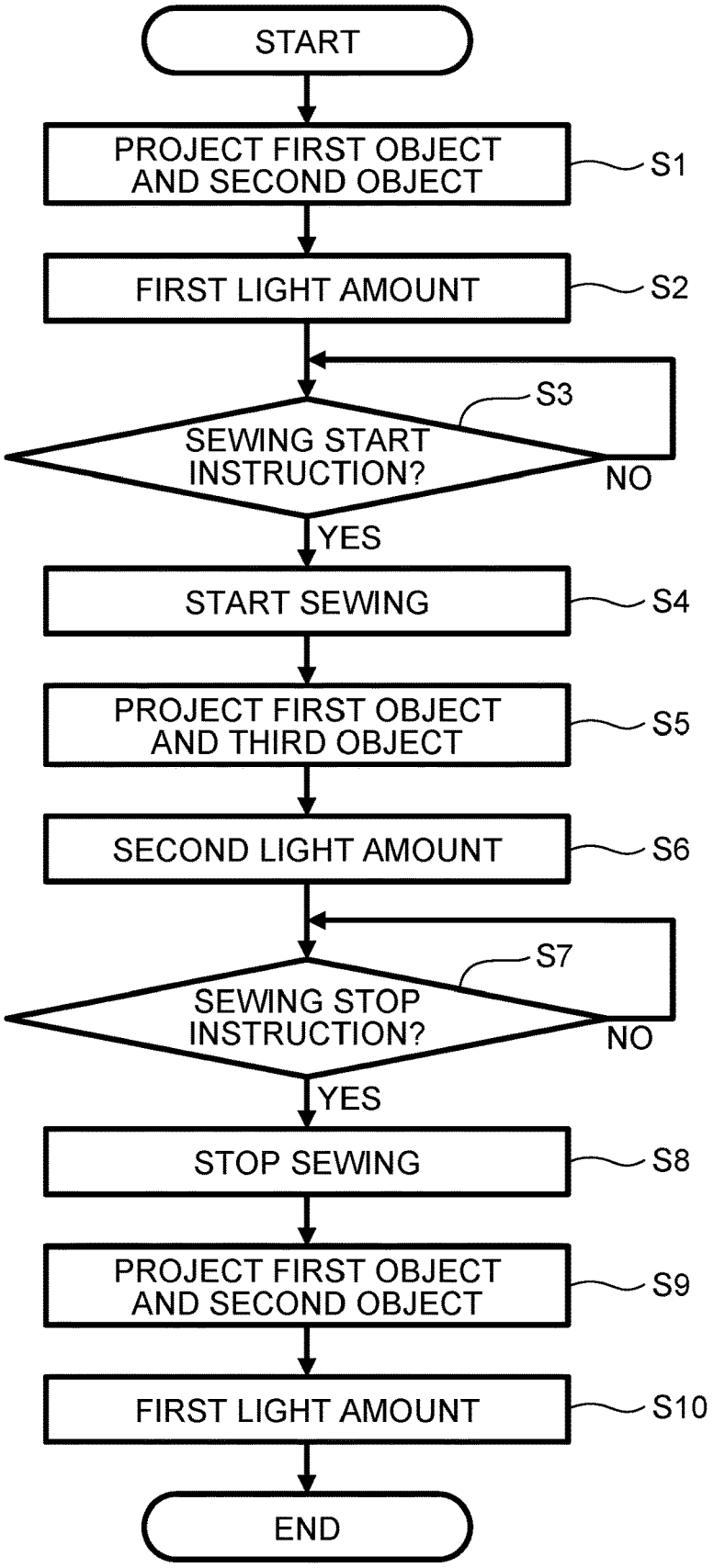
FIG. 4 is a flowchart of a main process according to a first embodiment of the disclosure.

Referring to FIGS. 4 and 5, a main process according to the first embodiment is described. The main process is executed for sewing straight lines and includes a process for changing a projection image that the projector 58 projects to the bed 2, and a process for changing the operation of the lighting unit 39, which are executed depending on whether the machine motor 33 is driven to perform sewing. When receiving the start of the main process instructed on the touchscreen 32, the controller 80 reads out a program for executing the main process stored in the program storage area of the ROM 82, into the RAM 83. The CPU 81 executes the following steps based on the instructions included in the program read into the RAM 83. The flash memory 84 stores parameters required for executing the main process. Various data obtained during the main process are stored in the RAM 83 at appropriate times. In this example, the thickness of a workpiece C is previously detected using a known technique (which is disclosed in, for example, Japanese Laid-Open Patent Publication No. 2009-291416), to calculate the coordinates of points of a projection image. The methods to detect the thickness of the workpiece C and to calculate the coordinates of points of a projection image may be changed as appropriate.

Figure 5A:
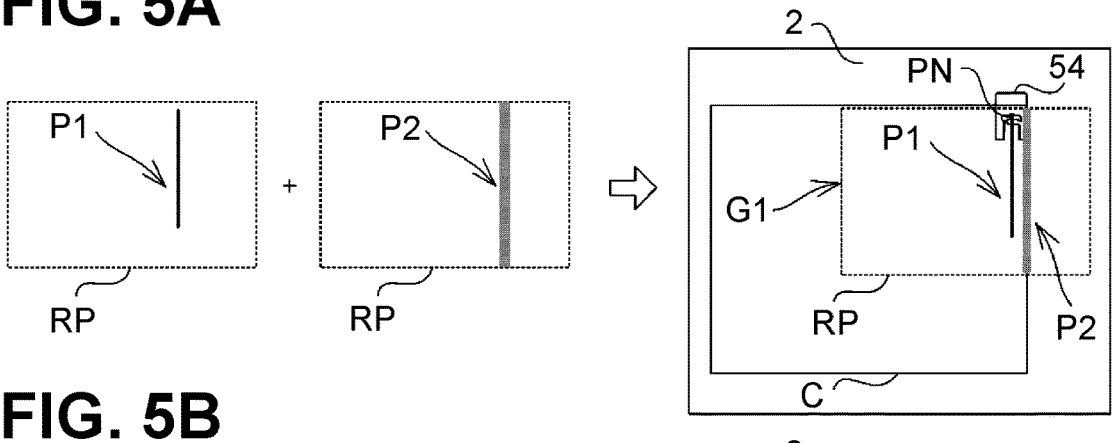
FIGS. 5A-5C are plan views each indicating a positional relationship of a first image, a second image, and a needle drop position in a projection area.
Figure 5B:
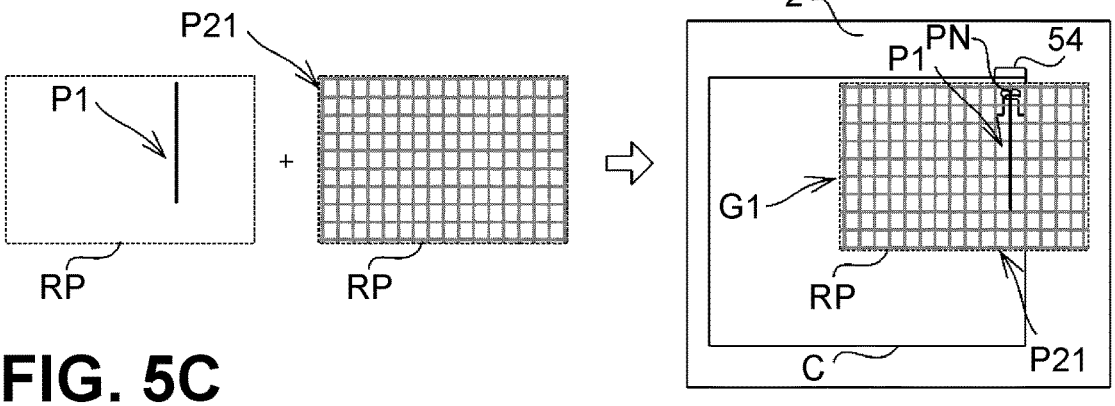

As illustrated in FIG. 4, the controller 80 executes a first control in which the controller 80 controls the drive circuit 67 and the light source 56 to project a first image including a first object and a second object to the bed 2 (S1). The first object indicates a planned sewing position. The second object indicates a reference position to position the workpiece C. As illustrated in FIG. 5A, the first object P1 of this example is a line segment extending from a needle drop position PN toward the front, and indicates a planned position for stitches to be formed on the workpiece C to be fed in the feed direction. The second object P2 is a line segment spaced from the first object P1 to the right by a specified distance. The specified distance represents a seam allowance of the workpiece C, for example. The second object P2 extends to the front more than the first object P1. Each object P1, P2 may be assigned with a different color from that of the workpiece C. For example, the first object P1 is red and the second object P2 is white. Image data to project the first image G1 is generated by superimposing image data representing the first object P1 in a projection area RP on image data representing the second object P2 in the projection area, for example. The image data to project the first image G1 may be prestored in the flash memory 84 or other memory. Each object may be changed as appropriate. As illustrated in FIG. 5B, a second object P21 is a grid provided in the entire projection area RP. In this case, the first object P1 and the second object P21, which overlap with each other in the first image G1, are projected in different colors distinguishably.

The controller 80 executes a third control in which the controller 80 controls the drive circuit 66 to adjust a light amount of the light source 35 to a first light amount and cause the lighting unit 39 to emit light with the first light amount (S2). The light amount refers to a total amount of pencils of light passing through a surface in a fixed time, and indicates brightness. The first light amount is smaller than a second light amount that refers to a light amount in sewing. The light amount may be adjusted as appropriate according to a type of the light source 35 of the lighting unit 39. When the light source 35 is an LED, the controller 80 may adjust the light amount by changing an on-off ratio for blinking the light source 35. The user seeing the projected first image G1 determines the sewing start position to the needle drop position PN, aligns the right end of the workpiece C with the second object P2 and then presses the start/stop switch 43 to input a sewing start instruction.

Figure 5C:
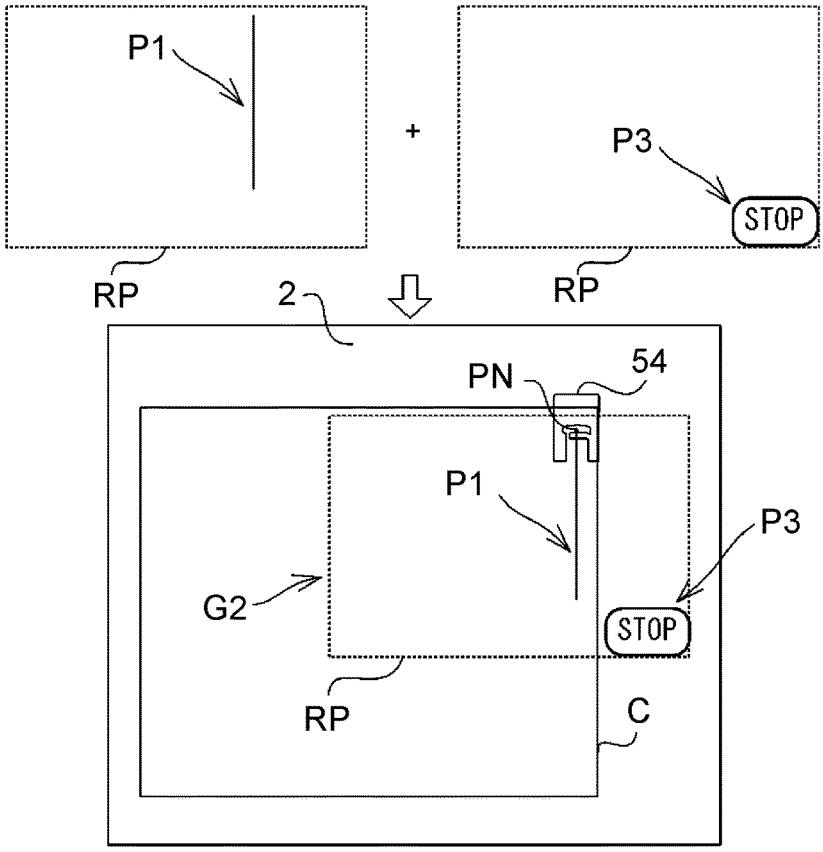

The controller 80 waits until the controller 80 receives the sewing start instruction (S3: NO). When receiving the sewing start instruction via the start/stop switch 43 (S3: YES), the controller 80 controls the drive circuit 61 to cause the feed unit 21 and the sewing unit 30 to perform sewing (S4). The controller 80 executes a second control in which the controller 80 controls the drive circuit 67 and the light source 56 to cause the projector 58 to project a second image to the bed 2 (S5). The second image includes a first object and does not include a second object. In this example, the controller 80 projects the second image instead of the first image. In step S5, the controller 80 ends projection of the first image and projects the second image only. As illustrated in FIG. 5C, the second image G2 of this example excludes the second object P2 (P21), and includes the first object P1 and a third object P3. The third object P3 is different from the first object P1 and the second object P2 (P21). The third object P3 is projected at a position spaced from the first object P1. The third object P3 of this example includes a text "STOP" and an oval surrounding the text and elongated in the left-right direction. The third object P3 is located in a front right portion of the projection area RP. The controller 80 executes a fourth control in which the controller 80 controls the drive circuit 66 to adjust the light amount of the light source 35 to a second light amount and cause the lighting unit 39 to emit light with the second light amount (S6).

The user inputs a sewing stop instruction to the sewing machine 1 by pressing the start/stop switch 43 or selecting the third object P3 being projected using the ultrasonic pen 90. The controller 80 can find that the third object P3 has been selected using the ultrasonic pen 90 by utilizing signals output from the signal output circuit 98 and the receivers 94, 95 in a known manner (described in Japanese Laid-Open Patent Publication No. 2014-087506, for example). The controller 80 continues sewing operation until the controller 80 receives the sewing stop instruction (S7: NO). Where the start/stop switch 43 is pressed or selection of the third object P3 being projected is detected (S7: YES), the controller 80 controls the drive circuit 61 to execute a stop control to stop sewing (S8). Where the controller 80 receives the sewing stop instruction (S7: YES), the controller 80 executes the stop control (S8) and then the first control. The controller 80 executes the first control, as in the case of step S1, where the controller 80 controls the drive circuit 67 and the light source 56 to project the first image G1 including the first object P1 and the second object P2 (S9). In this example, the controller 80 projects the first image G1 instead of the second image G2. Namely, in S9, the controller 80 ends projection of the second image G2 and projects the first image G1. In steps S1 and S9, at least one of the first image and the second image may be changed. The controller 80 executes the third control, as in the case of step S2, in which the controller 80 controls the drive circuit 66 to adjust the light amount of the light source 35 to the first light amount and cause the lighting unit 39 to emit light with the first light amount (S10). The controller 80 thus ends the main process.

Figure 6:
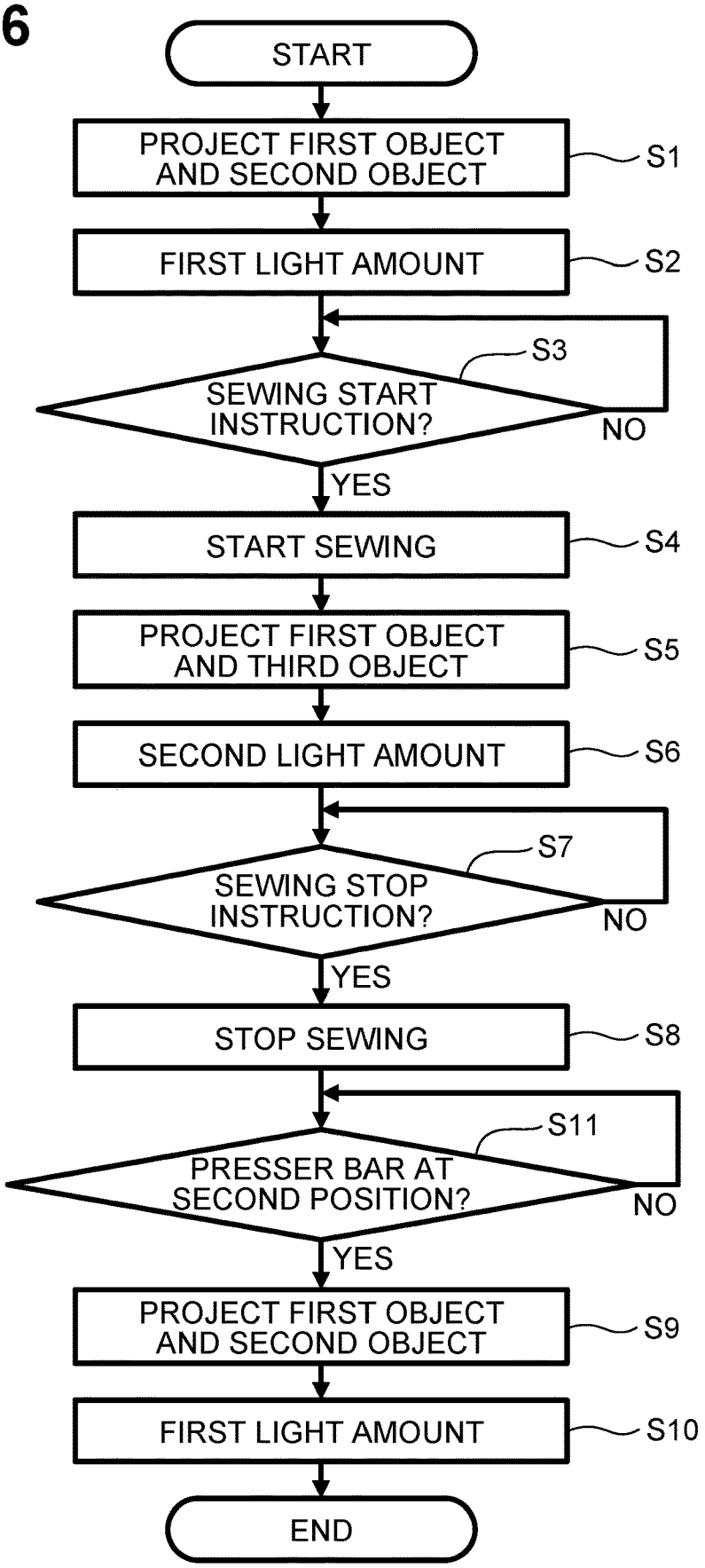
FIG. 6 is a flowchart of a main process according to a second embodiment of the disclosure.

Referring to FIG. 6, a main process according to a second embodiment is described. The second embodiment is different from the first embodiment, in that the main process includes a step S11 to be executed between steps S8 and S9. In the following description, steps similar to those described in the first embodiment are designated by similar numerals and thus the description thereof can be omitted for the sake of brevity. Hereinafter, a description is made of step S11, which is not included in the first embodiment. In step S11, the controller 80 determines whether the presser bar 53 is at the second position (S11). When the presser bar 53 is at the second position, the presser foot 54 attached to the lower end of the presser bar 53 is spaced apart from the workpiece C. The controller 80 determines that, when the presser switch 44 is pressed with the presser bar 53 at the first position, the presser bar 53 is at the second position. After stopping sewing (S8), the controller 80 waits until the presser switch 44 is pressed (S11: NO). Where the presser switch 44 is pressed, the controller 80 determines that the presser bar 35 is at the second position (S11: YES), and executes steps S9 and S10, which are similar to those in the first embodiment. In the main process in the second embodiment as described above, when the feed unit 21 and the sewing unit 30 do not perform sewing and the presser bar 53 is at the second position, the controller 80 executes the first control (S9).

Figure 7:
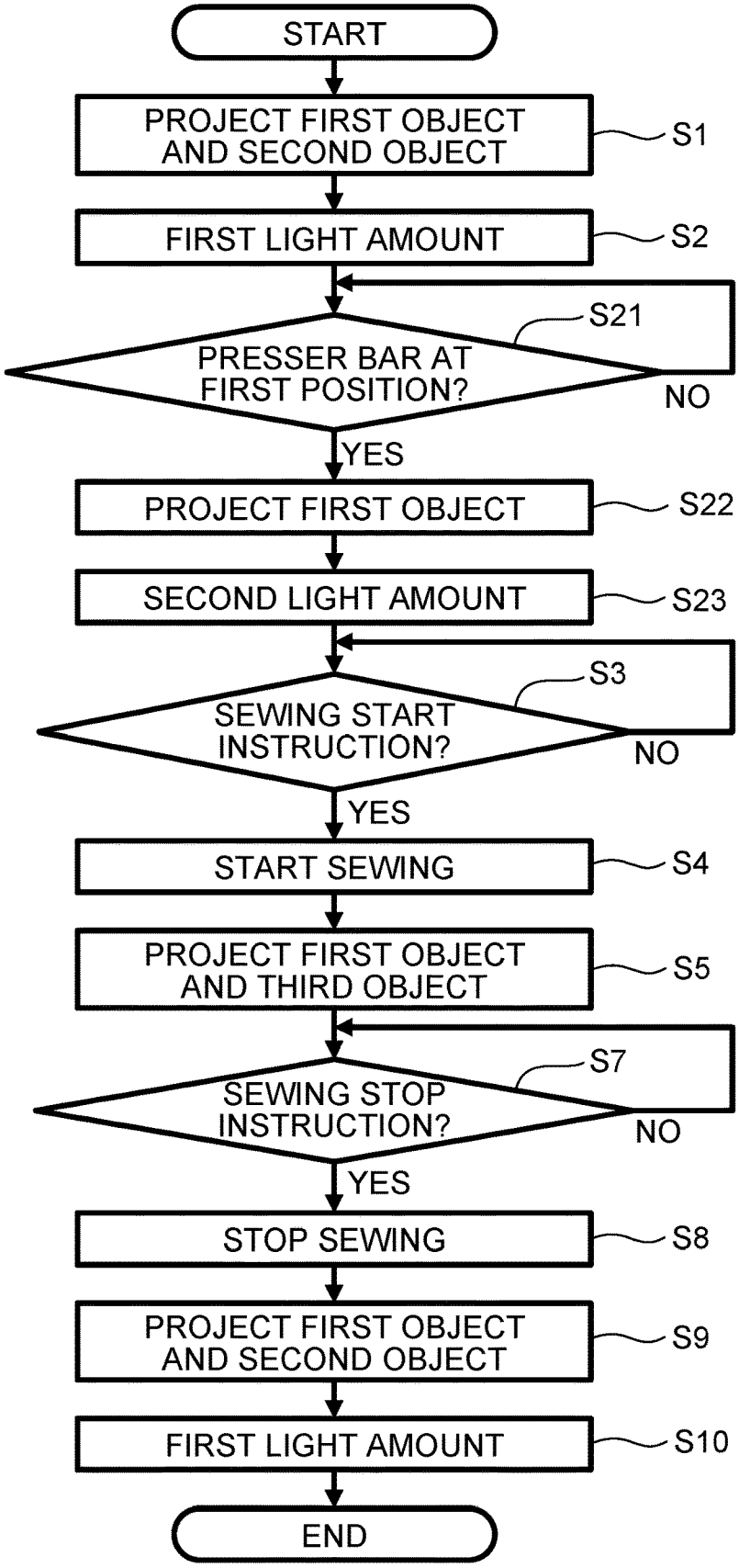
FIG. 7 is a flowchart of a main process according to a third embodiment of the disclosure.

Referring to FIGS. 7 and 8, a main process according to a third embodiment is described. As illustrated in FIG. 7, the third embodiment is different from the first embodiment, in that the main process includes steps S21 to S23 to be executed between steps S2 and S3 and omits step S6 from between steps S5 and S7. In the following description, steps similar to those described in the first embodiment are designated by similar numerals and thus the description thereof can be omitted for the sake of brevity. Hereinafter, a description is made of steps S21 to S23, which are not included in the first embodiment. In step S21, the controller 80 determines whether the presser bar 53 is at the first position (S21). When the presser bar 53 is at the first position, the presser foot 54 attached to the lower end of the presser bar 53 contacts and presses the workpiece C downward.

Figure 8A:
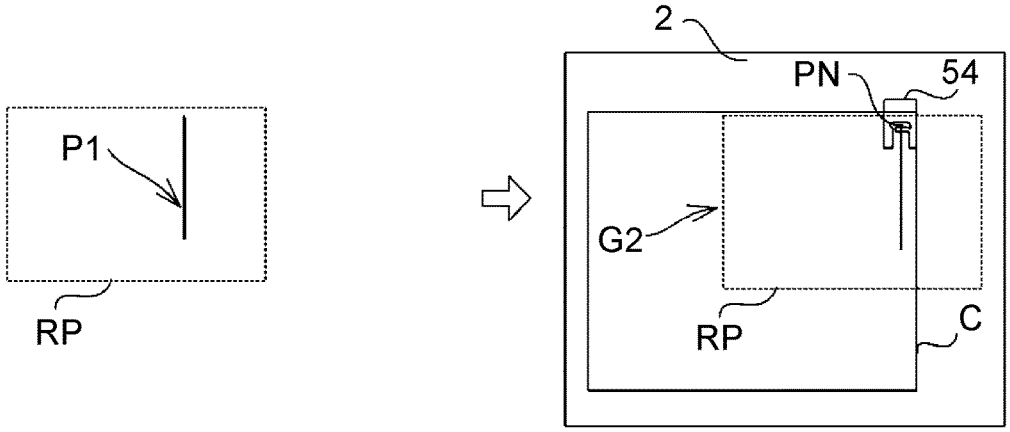
FIGS. 8A-8C are plan views each indicating a positional relationship of a first image, a second image, and a needle drop position in a projection area.

When the presser switch 44 is pressed with the presser bar 53 at the second position, the controller 80 determines that the presser bar 53 is at the first position. The controller 80 waits until the presser switch 44 is pressed (S21: NO). Where the presser switch 44 is pressed, the controller 80 determines that the presser bar 53 is at the second position (S21: YES), and projects the second image including the first object to the bed 2 (S22). As in the case of step S5, the controller 80 projects the second image instead of the first image. As illustrated in FIG. 8A, the second image G2 includes only the first object P1 extending from the needle drop position PN toward the front. The controller 80 controls the drive circuit 66 to adjust the light amount of the light source 35 to the second light amount and cause the lighting unit 39 to emit light with the second light amount (S23), and then executes steps S3 to S5. The controller 80 does not change the light amount of the light source 35 between steps S5 and S7, as the controller 80 causes the lighting unit 39 to emit light with the second light amount in step S23. In the main process in the third embodiment as described above, when the feed unit 21 and the sewing unit 30 do not perform sewing and the presser bar mover 77 moves the presser bar 53 from the second position to the first position (S21: YES), as well as when the feed unit 21 and the sewing unit 30 perform sewing, the controller 80 executes the second control (S22).

Figure 8B:
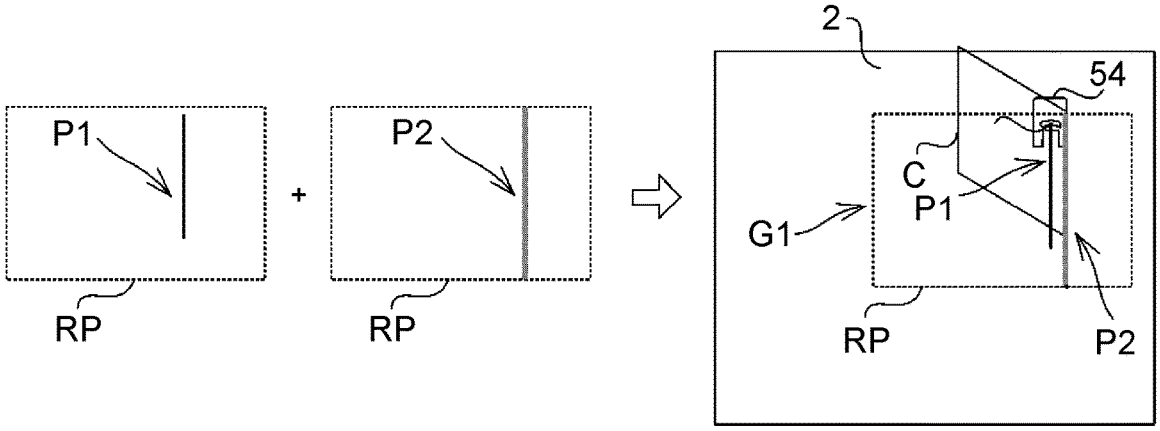
Figure 8C:
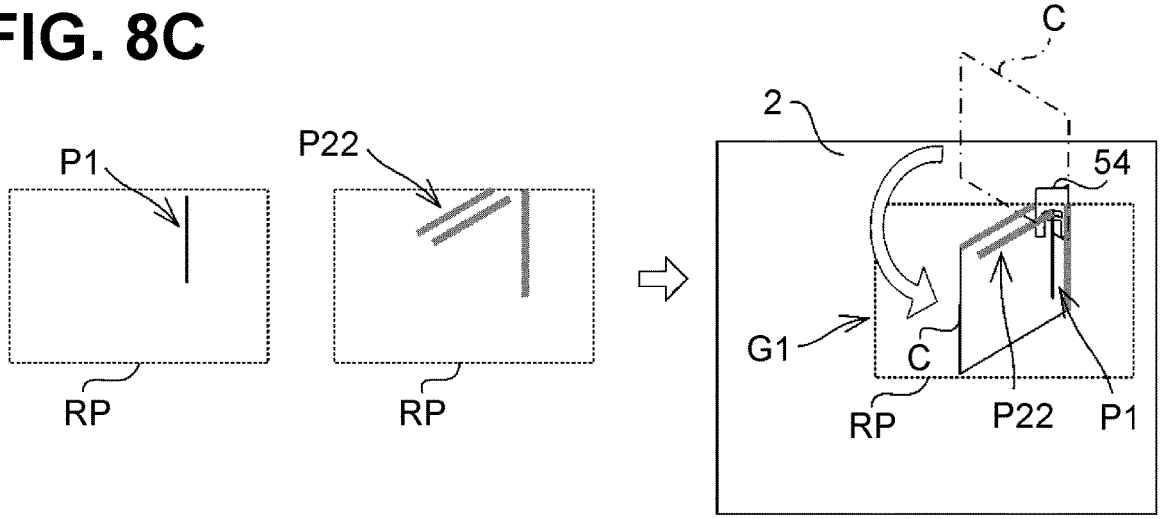
Figure 9:
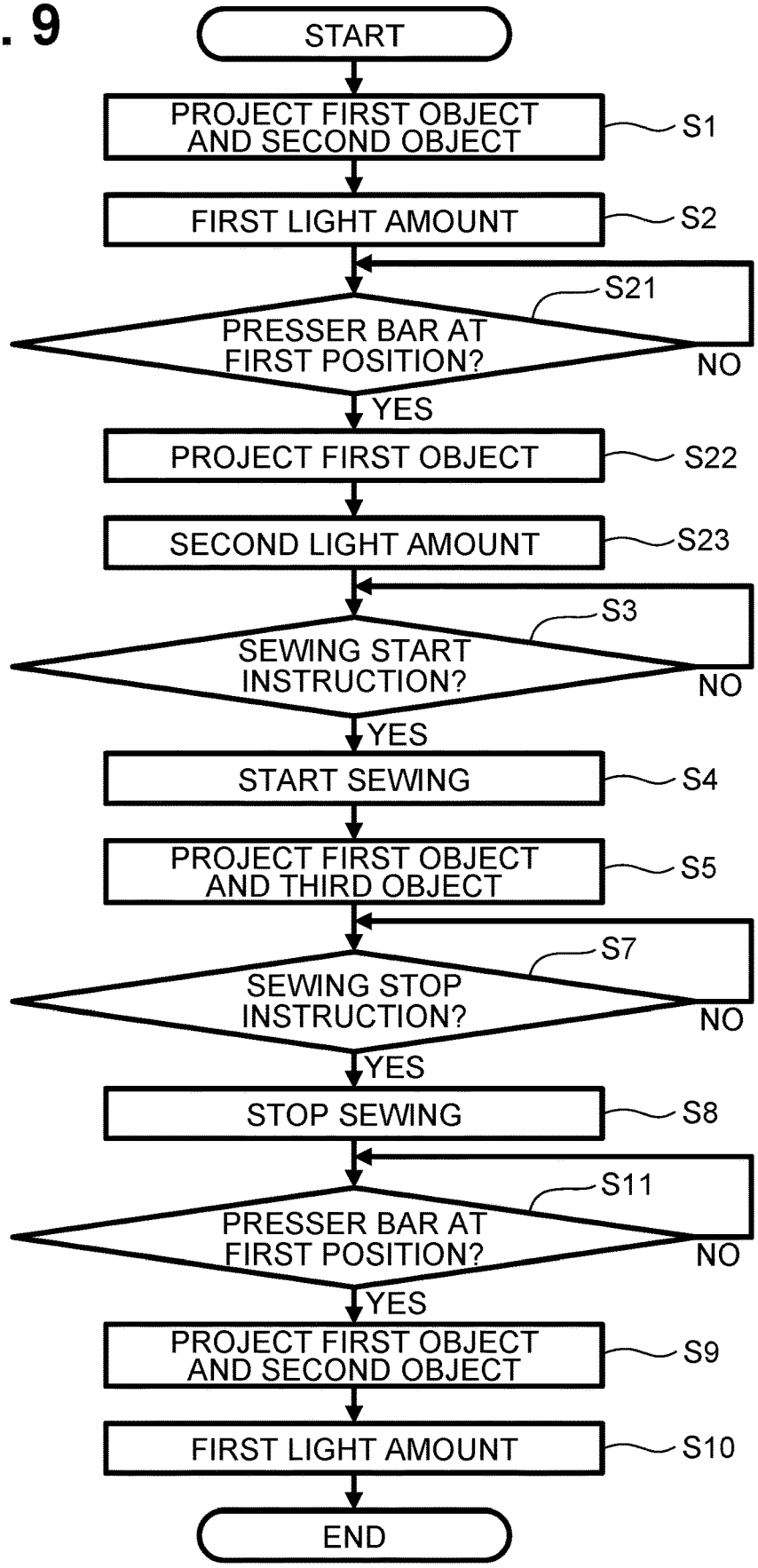
FIG. 9 is a flowchart of a main process according to a fourth embodiment of the disclosure.

Referring to FIGS. 8 and 9, a main process according to a fourth embodiment is described. As illustrated in FIG. 9, the fourth embodiment is different from the first embodiment and similar to the third embodiment, in that the main process includes steps S21 to S23 to be executed between steps S2 and S3 and omits step S6 from between steps S5 and S7. The fourth embodiment is different from the first embodiment and similar to the second embodiment, in that the main process includes step S11 to be executed between steps S8 and S9. In the fourth embodiment, the description of steps S21 to S23 and step S11 is omitted for the sake of brevity.

For stitching on a diamond-shaped workpiece C with seam allowance, for example, for patchwork, in step S1 of the main process in the fourth embodiment, the controller 80 controls the drive circuit 67 and the light source 56 to project a first image G1 including a first object P1 and a second object P2 illustrated in FIG. 8B (S1), and then controls the drive circuit 66 to adjust the light amount of the light source 35 to the first light amount and cause the lighting unit 39 to emit light with the first light amount (S2). When the presser bar 53 is at the first position (S21: YES), the controller 80 projects a second image G2 including only the first object P1 illustrated in FIG. 8A (S22). In this case, the second image G2 does not include the second object P22 and the third object P3. The controller 80 controls the drive circuit 66 to adjust the light amount of the light source 35 to the second light amount and cause the lighting unit 39 to emit light with the second light amount (S23). When receiving the sewing start instruction (S3: YES), the controller 80 controls the drive circuit 61 to start sewing (S4), and then controls the drive circuit 67 and the light source 56 to project the second image G2 including the first object P1 and the third object P3, which are illustrated in FIG. 5C (S5).

When receiving the sewing stop instruction (S7: YES), the controller 80 controls the drive circuit 61 to stop sewing (S8). When the presser switch 44 is pressed with the presser bar 53 at the first position or when the presser bar 53 is at the second position (S11: YES), the controller 80 controls the drive circuit 67 and the light source 56 to project the first image G1 including the first object P1 and the second object P22, which are illustrated in FIG. 8C (S9). The controller 80 controls the drive circuit 66 to adjust the light amount of the light source 35 to the first light amount and cause the lighting unit 39 to emit light with the first light amount (S10). When changing the sewing direction at a corner point of the workpiece C, the user moves the presser bar 53 up to the second position with the needle 52 inserted in the corner point of the workpiece C, and then rotates the workpiece C around the needle 52. As illustrated in FIG. 8C, the user rotates the workpiece C using the first object P1 and the second object P22 in the projection image, as a guide. The controller 80 thus ends the main process. To continue sewing, the main process is restarted.

In the first through fourth embodiments, the sewing machine 1, the bed 2, the feed dog 24, the feed unit 21, the needle bar 51, the sewing unit 30, the projector 58, and the controller 80 are each an example of a sewing machine, a bed, a feed dog, a feed dog, a feed unit, a needle bar, a sewing unit, a projector, and a controller, of the disclosure. Step S1 is an example of a first control of the disclosure. Step S5 is an example of a second control of the disclosure. The start/stop switch 43 is an example of an operation unit of the disclosure. The presser bar 53 is an example of a presser bar of the disclosure, and the presser bar mover 77 is an example of a presser bar mover of the disclosure. The receivers 94, 95 are an example of a detector of the disclosure. The light source 35 is an example of a light source of the disclosure, and the lighting unit 39 is an example of a lighting unit of the disclosure. Steps S2 and S10 are an example of a third control of the disclosure. Step S6 is an example of a fourth control of the disclosure.

The sewing machine 1 changes objects included in an image to be projected, depending on whether sewing is performed. During a non-sewing period, the sewing machine 1 projects the first image G1 including the first object P1 that indicates a planned sewing position and the second object P2 (P21, P22) that indicates a reference position to position the workpiece C (S1, S9). The sewing machine 1 can thus improve the efficiency of positioning the workpiece C as compared to a sewing machine that projects an image including one object. The sewing machine 1 improves sewing efficiency by reducing the number of objects included in the second image G2 to be projected during sewing, as compared to a case where the number of objects included in an image to be projected is unchanged between during sewing and during a non-sewing period. The sewing machine 1 can thus improve the efficiency of positioning the workpiece C without loss of the efficiency of sewing the workpiece C.

The sewing machine 1 includes the start/stop switch 43. When receiving the sewing start instruction via the start/stop switch 43, the controller 80 causes the feed unit 21 and the sewing unit 30 to perform sewing and causes the projector 58 to project the second image G2 (S5). This saves the user from having to input an instruction to start step S5 and an instruction to start sewing, separately, to the sewing machine 1. The sewing machine 1 can thus project the second image G2 reliably during sewing. When receiving the sewing stop instruction via the start/stop switch 43 or the ultrasonic pen 90, the controller 80 executes the stop control to stop sewing (S8) and then the first control (S9). When sewing is stopped, the sewing machine 1 can automatically change the projector 58 to the first control. This enables the user to speedily prepare the next sewing operation.

The sewing machine 1 according to the third and fourth embodiments includes the presser bar 53, the presser foot 54 attached to the lower end of the presser bar 53, and the presser bar mover 77 configured to move the presser bar 53 between the first position in proximity to the bed 2 and the second position spaced upward from the bed 2 further than the first position. The controller 80 executes the first control to project the first image G1 when the feed unit 21 and the sewing unit 30 do not perform sewing and the presser bar 53 is at the second position (S2, S9). The controller 80 executes the second control when the feed unit 21 and the sewing unit 30 perform sewing (S5). The controller 80 executes the second control to project the second image G2 even when the feed unit 21 and the sewing unit 30 do not perform sewing and the presser bar mover 77 moves the presser bar 53 from the second position to the first position (S22). When the presser bar 53 is moved from the second position to the first position, the presser foot 54 attached to the lower end of the presser bar 53 presses the workpiece C downward. The workpiece C is thus aligned near the needle drop position PN. In other words, it is assumed that, when the presser bar 53 is moved from the second position to the first position, positioning of the workpiece C has been completed. The sewing machine 1 can change the projector 58 from the first control to the second control automatically when the presser bar 53 is moved from the second position to the first position. After the presser bar 53 is moved from the second position to the first position (S21: YES), the user can check the position of the workpiece C in an illuminated state with a light amount greater than the first light amount. In other words, the sewing machine 1 eliminates the necessity for the user to adjust the light amount of the lighting unit 39 for checking the position of the workpiece C when the presser bar 53 is moved from the second position to the first position.

In the sewing machine 1 according to the second and fourth embodiments, where the feed unit 21 and the sewing unit 30 do not perform sewing in the sewing stop control (S8) and the presser bar 53 is moved from the first position to the second position (S11: YES), the controller 80 executes the first control to project the first image G1 (S9). To change the sewing direction during sewing, the user usually temporarily stops sewing, inserts the needle 52 into the workpiece C, and then moves the needle bar 53 to the second position with the needle 52 inserted in the workpiece C. After changing the sewing direction on the workpiece C, the user restarts sewing by the sewing machine 1. Thus, the sewing machine 1 can change the control of the projector 58 according to the position of the presser bar 53. In this example, the sewing machine 1 can project the first image G1 including the second object P2 (P21) that indicates a reference position of the workpiece C, and this enables the user to position the workpiece C while viewing the image projected thereon. By executing step S11, the sewing machine 1 maintains the projector 58 in the second control when sewing is stopped with the presser bar 53 at the first position. Where sewing is stopped, sewing needs to be resumed without changing the position of the workpiece C. The controller 80 may determine whether, where the presser bar 53 is not at the second position (S11: NO), the controller 80 receives a sewing restart instruction. In this case, where the controller 80 receives a sewing restart instruction, the controller 80 may restart sewing and return to step S7, else the controller 80 may return to S11.

The controller 80 of the sewing machine 1 according to the first through fourth embodiments causes, in the second control, the projector 58 to project the second image G2 including the first object P1 and the third object P3, which is different from the first object P1 and the second object P2 (P21, P22) (S5). The sewing machine 1 can change objects included in an image to be projected by the projector 58, depending on whether sewing is performed, while projecting the first object P1 which is included in both the first image G1 and the second image G2.

The sewing machine 1 according to the first through fourth embodiments includes the receivers 94, 95 configured to detect selection of a third object P3 being projected. Where selection of the third object P3 being projected is detected (S7: YES), the controller 80 executes a stop control to stop sewing (S8). This enables the sewing machine 1 to project the third object P3 for instructing a sewing stop during sewing operation. The user can input a sewing stop instruction by selecting the projected third object P3.

Where selection of the third object P3 being projected is detected (S7: YES), the controller 80 of the sewing machine 1 according to the first through fourth embodiments executes the first control (S9) in addition to the stop control (S8). Where sewing is stopped, the sewing machine 1 can automatically change the projector 58 to the first control. This enables the user to speedily prepare the next sewing operation.

The controller 80 of the sewing machine 1 according to the first through fourth embodiments causes the third object P3 to be projected at a position spaced from the first object P1 in the second control (S5). The sewing machine 1 thus projects the first object P1 and the third object P3 distinguishably from each other as compared to a case where the third object P3 is projected at a position overlapping with the first object P1.

The sewing machine 1 according to the first through fourth embodiment includes the lighting unit 39 having the light source 35 to emit light to the bed 2. The controller 80 executes the third control to adjust the light amount of the light source 35 to the first light amount and cause the lighting unit 39 to emit light with the first light amount during the period of executing the first control (S2). The controller 80 executes the fourth control to adjust the light amount of the light source 35 to the second light amount greater than the first light amount and cause the lighting unit 39 to emit light with the second light amount (S6). The sewing machine 1 thus can control the light amount of the light source 35 in accordance with an image to be projected by the projector 58. During sewing, a relatively large light amount is desirably allocated to the light source 35. For easy visual check of a projected image, a relatively small light amount is desirably allocated to the light source 35. The sewing machine 1 thus enables the lighting unit 39 to emit light with a light amount of the light source 35 suitable for projecting an image.

While aspects are described in detail with reference to the specific embodiments thereof, these are merely examples, and various changes, arrangements and modifications may be made therein without departing from the spirit and scope of the disclosure. For example, the following modifications (A) to (C) may be made to the above embodiments.

(A) Configuration of the sewing machine 1 may be modified as appropriate. Examples of the sewing machine 1 include an industrial sewing machine and a multi-needle sewing machine. The type, location, and other details of the projector may be changed as appropriate. The positional relationships among the objects in the projection area may be changed as appropriate. Some operation units may be allocated to the touchscreen as appropriate. The type, location, and other details of the detector may be changed or omitted as appropriate. For example, the sewing machine may include, as a detector, an imaging device (e.g., a complementary metal oxide semiconductor, COMS, sensor) configured to capture an image including an indicator such as a finger or a known light-emitting pen whose end emits light when turned on and then detect a position of the indicator using the image, thereby detecting selection of a third object.

(B) A program including instructions to execute the main process may be stored in a storage device of the sewing machine 1 until the controller 80 executes the program. Thus, a method for obtaining the program, a route through which the program is obtained, and a device that stores the program may be changed as appropriate. The program to be executed by the controller 80 may be received from another device via a cable or wireless communication, and may be stored in a storage device such as a flash memory. Examples of the other device include a PC and a server connected via a network.

(C) The steps in the main process (FIGS. 4, 6, 7, and 9) of the sewing machine 1 are not limited to being executed by the controller 80, but some or all of the steps may be executed by another electronic device (e.g., an ASIC). In some embodiments, the steps of the main process may be executed by multiple electronic devices (e.g., CPUs). The steps of the main process may be executed in a different order. A step may be omitted from or added to the main process. The scope of the disclosure includes such configuration that an operating system (OS) operating on the sewing machine 1 executes some or all of the steps of the main process based on a command/instruction from the controller 80. For example, the following modifications (C-1) to (C-3) may be added to the main process.

(C-1) The first object, the second object, and the third object may be changed as appropriate. Examples of each object include a figure, a pattern, a character, a letter, and other items to be imaged. The second object may be radial lines drawn from a needle drop position and decided by angle between them. The first object may be a solid line, a dotted line, a chain line, and other lines, each having width and color to be changed as appropriate. The first object may be a utility stitch pattern in accordance with a type of stitch to be formed. The first image includes at least the first object and the second object. The first image may include other objects. The second image excludes the second object and includes the first object. The second image to be projected during sewing may preferably have fewer pixels of object(s) (or a smaller area) than the first image. The second image may not include the third object.

(C-2) Details of the third object may be changed as appropriate. A process when selection of the third object is detected may be changed as appropriate. Where the selection of the third object is detected, sewing conditions may be changed. For example, the sewing speed may be reduced or increased. The third object may overlap with the first object. In this case, the image G1 in FIG. 5B is an example of the first image, and the image G1 in FIG. 5A is an example of the second image. With each image set in this manner, the user can use the second object P2 as a reference position to form stitches at a position spaced by a fixed distance from the right edge of the workpiece. The controller may not detect the selection of the third object.

(C-3) The first control may be executed at least in a particular period during which the feed unit and the sewing unit do not perform sewing, and may not be necessarily executed at all times during which the feed unit and the sewing unit do not perform sewing. The second control may not be necessarily executed at all times during which the feed unit and the sewing unit perform sewing. For example, while the feed unit and the sewing unit perform sewing, the sewing machine may change the control of the projector when receiving an instruction to change the control of the projector from the second control to the first control. The controller may not change the control of the projector in accordance with the presser bar moved by the presser bar mover. While sewing is stopped, the controller may execute at least one of the first control and the third control when the presser bar mover moves the presser bar from the first position to the second position, and may execute at least one of the second control and the fourth control when the presser bar is moved from the second position to the first position. Where selection of the third object being projected is detected, the controller may execute a stop control to stop sewing and may not execute at least one of the first control and the third control. The third control and the fourth control may be eliminated as appropriate. For example, the light amount of the light source of the lighting unit during execution of the main process may be fixed. The controller may change the light amount of the projector in the first control and the second control. The light amount of the projector may be greater in the first control than in the second control.

What is claimed is:

1. A sewing machine comprises:

a bed;

a projector; and a controller configured to cause the projector to project a grid pattern and a stitch pattern towards the bed in a first case, and project the stitch pattern towards the bed and not project the grid pattern towards the bed in a second case.

2. The sewing machine according to claim 1, wherein the controller is configured to cause the projector to project the grid pattern with a first color and the stitch pattern with a second color that is different from the first color.

3. The sewing machine according to claim 1, further comprising a feed dog configured to feed a workpiece placed on the bed in a feed direction.

4. The sewing machine according to claim 1, wherein the first case is a non-sewing period and the second case is a sewing period.

5. The sewing machine according to claim 1 further comprises a presser foot, wherein the controller is configured to cause the projector to project the grid pattern towards the bed so that a portion of the grid pattern is projected onto the presser foot.

6. The sewing machine according to claim 1 further comprises a presser foot, wherein the controller is configured to cause the projector to project the stitch pattern towards the bed so that a portion of the stitch pattern is projected onto the presser foot.

7. A sewing machine control method, comprising:

projecting, by a projector of a sewing machine, a grid pattern and a stitch pattern towards a bed of the sewing machine in a first case; and projecting, by the projector of the sewing machine, the stitch pattern towards the bed of the sewing machine without projecting the grid pattern in a second case.

* * * * *